US007052239B1

(12) United States Patent
Riske

(10) Patent No.: US 7,052,239 B1
(45) Date of Patent: May 30, 2006

(54) OSCILLATING FAN CLUTCH

(75) Inventor: Stanley J. Riske, Hanover, MI (US)

(73) Assignee: Airmaster Fan Company, Jackson, MI (US)

( * ) Notice: Subject to any disclaimer, the term of this patent is extended or adjusted under 35 U.S.C. 154(b) by 0 days.

(21) Appl. No.: 10/608,919

(22) Filed: Jun. 27, 2003

(51) Int. Cl.
*B63H 3/00* (2006.01)

(52) U.S. Cl. ..... 416/100; 192/56.62

(58) Field of Classification Search ..... 416/100, 416/112, 116; 192/56.62; 464/36
See application file for complete search history.

(56) References Cited

U.S. PATENT DOCUMENTS 1,337,644 A 4/1920 Dilg
2,209,155 A * 7/1940 Fagg ..... 192/56.62
2,341,220 A * 2/1944 Jordan ..... 416/100
2,732,746 A * 1/1956 Livermont ..... 464/36
2,838,956 A 6/1958 Schneider
2,900,127 A 8/1959 Smith
3,147,639 A 9/1964 Braskamp
6,468,036 B1 10/2002 Song et al.

* cited by examiner

*Primary Examiner*—Theresa Trieu
(74) *Attorney, Agent, or Firm*—Gifford, Krass, Groh, Sprinkle, Anderson & Citkowski, PC

(57) ABSTRACT

The invention pertains to a clutch for an oscillating fan wherein the clutch may be preadjusted for producing various degrees of oscillation, but will automatically adjust to a lesser degree of oscillation if the fan movement is restrained due to the fan's encounter with a stationary object. If necessary, the fan oscillation will automatically adjust to 0° oscillation if a severe obstruction is encountered.

4 Claims, 2 Drawing Sheets

OSCILLATING FAN CLUTCH

FIELD OF THE INVENTION

The invention pertains to drive clutches for oscillating air fans wherein the degree of fan oscillation may be adjusted.

RELATED PRIOR ART

Oscillating fans have long been available wherein the fan moves in an oscillating manner to distribute the airstream over a large area, and thus more effectively ventilate an area than a stationary fan. Oscillating fans are made in all sizes and are commonly available with small household fans, as well as with large commercial units.

Fan oscillation is driven by the fan motor rotating the blade. A clutch is usually interposed between the oscillation drive and the oscillating lever which has one end stationarily mounted upon the fan frame, and the other end upon a crank pin driven by the fan motor. It is common that the clutch incorporate adjusting means so that the crank pin distance from the drive shaft may be varied in order to adjust the degree of fan oscillation. By adjusting the "throw" of the oscillating pin the area covered by the fan moving airstream can be readily designed for the particular space in which the fan is used.

Unfortunately, oscillating fans are sometimes located adjacent stationary objects, or in locations wherein fan clearance is restricted, and the degree of oscillation for which the oscillation drive clutch is adjusted is greater than the degree of movement that the fan is capable of, or perhaps, an object has been moved into an interference position with respect to the path of the oscillating fan. In such instances, the encounter of the moving fan structure during oscillation with the stationary object will cause the oscillation to cease stalling out the oscillation drive structure and the fan motor, rendering the fan inoperable.

Such unintended engagement of the oscillating fan with a stationary object as to stall the fan motor may result in the fan motor overheating and burning out, or becoming a fire hazard. It is for this reason that oscillating fans carry warning labels cautioning users not to place the fan, or adjust it, in such a manner as to cause interference with the oscillating movement. Such warnings are sometimes ignored.

OBJECTS OF THE INVENTION

It is an object of the invention to provide an oscillating drive for an oscillating fan wherein the drive may be easily adjusted to vary the degree of fan oscillation without the requirement of tools or special skills.

A further object of the invention is to provide an oscillating fan with an oscillating drive which is capable of self-adjustment if the fan movement is restrained against its adjusted degree of movement and the drive clutch automatically adjusts to a lesser degree of oscillation, even to 0°, to prevent oscillation completely.

A further object of the invention is to provide an oscillating fan clutch capable of easy adjustment for various degrees of oscillation, and automatically adjustable to a degree of oscillation movement as to prevent fan motor stalling and reduce the likelihood of damage to the fan or surrounding environment.

SUMMARY OF THE INVENTION

The oscillating fan clutch in accord with the invention uses a bell crank which is mounted upon a drive shaft operatively connected to the fan motor so that the bell crank will rotate when the fan motor is energized. An oscillating pin support is mounted upon the bell crank for relative rotation thereto about an axis which is offset with respect to the fan motor drive shaft axis.

A oscillating pin mounted upon the pin support cooperates with an oscillating lever wherein one end of the lever is mounted upon the pin, and the other lever end is mounted upon a fixed point on the fan structure offset with respect to the fan oscillating pivot. This structure is common to most oscillating fan clutch constructions.

The degree of oscillation is adjusted by varying the distance of the oscillating pin from the drive shaft axis. The greater this distance, the greater the degree of fan oscillation. If the axis of the pin coincides with the axis of the drive shaft no oscillation occurs.

The adjustment of the oscillating pin to the fan motor drive shaft is accomplished by the relative rotational location of the bell crank to the pin support which are interconnected by a connecting pin having a spring associated therewith whereby the bell crank and pin support are biased toward each other. Both the bell crank and the pin support include planar opposed surfaces spaced from such other and detents are interposed between the surfaces. A pair of recesses formed in the bell crank surface are diametrically on opposite sides of the connecting pin, while three sets of recesses are formed in the flat surface of the pin support. As recesses defined on both the bell crank and pin support are equally spaced from the connector pin spherical ball detents received within the recesses will be selectively engaged in order to maintain the relative rotation of position of the bell crank and pin support.

The recesses formed within the bell crank and pin support are semi-spherical to match the configuration of the ball detents, and the detents spherical configuration surface forms a cam with respect to the recess in which it is received as only about a third of the circumference of a detent ball is received within a recess. Accordingly, relative rotation of the ball crank and pin support varies the distance between the axis of the drive shaft and the oscillating lever pin varying the degree of fan oscillation.

The degree of fan oscillation is readily adjusted by manually rotating the pin support relative to the bell crank. The spring surrounding the connecting pin biasing the bell crank and pin support toward each other is compressed as the balls ride out of their associated recess for engagement of the ball detents with other recesses during the relative rotation which changes the distance between the axes of the drive shaft and the oscillating pin.

In the event that, during oscillation, the fan structure, motor housing, or fan guard, engages a fixed object, or relatively fixed object, a torque is immediately applied to the pin support by the oscillating lever. This torque, which will prevent further rotation of the pin support, causes the detent balls to ride out of their associated recesses and automatically adjust the rotation between the bell crank and pin support to reduce the degree of oscillation. If the adjustment of the ball detents in a new set of grooves does not sufficiently reduce the "throw" of the oscillating mechanism as to avoid the restraining force, the relative rotation between the bell crank and pin support continues until the axis of the oscillating pin coaxially aligns with the drive shaft axis reducing the fan oscillation to 0. Accordingly, this automatic adjustment of the degree of oscillation will prevent stalling of the fan motor and prevent overheating or motor burnout.

As will be appreciated, the structure of the oscillating fan clutch as described above is relatively simple so as to permit manual adjustment by those not mechanically skilled, and the objects of the invention are met.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
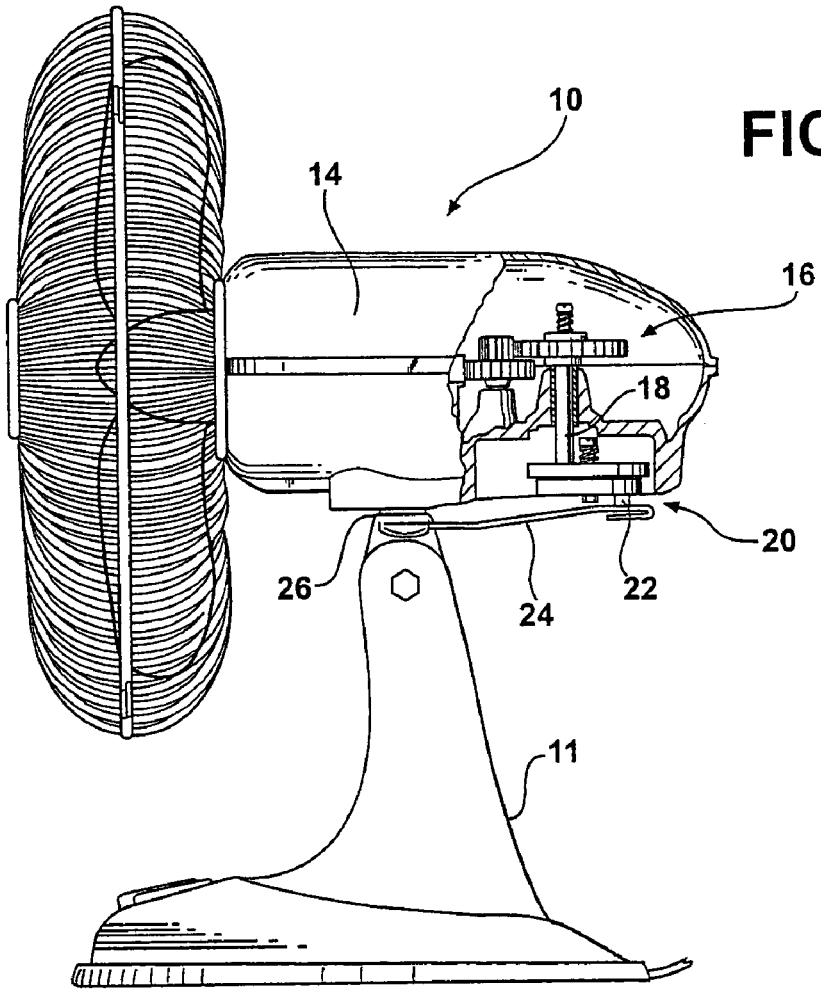
FIG. 1 is an elevation view of a typical oscillating fan, partially broken to show the oscillating drive mechanism.

In FIG. 1 a typical consumer-type fan pin is illustrated which includes a blade encased within a blade guard mounted on a base 11. The blade is operatively connected to the fan electric motor 14 located within a housing mounted on a vertical pin 26 on base 11.

The rear end of the fan motor 14 includes an oscillation drive generally indicated at 16 which includes a plurality of reduction gears and a downwardly extending drive shaft 18. The oscillating clutch of the invention is illustrated at 20 and is mounted upon the lower end of the fan motor drive shaft 18.

The clutch 20 includes an oscillating pin 22 which is connected at one end to the oscillating lever 24 whose other end is connected to a point on the stationary base 11, and the fan motor 14 and blade oscillate about the fan vertical pivot axis 26 as caused by the torque imposed on the oscillating fan structure by the lever 24.

Figure 2:
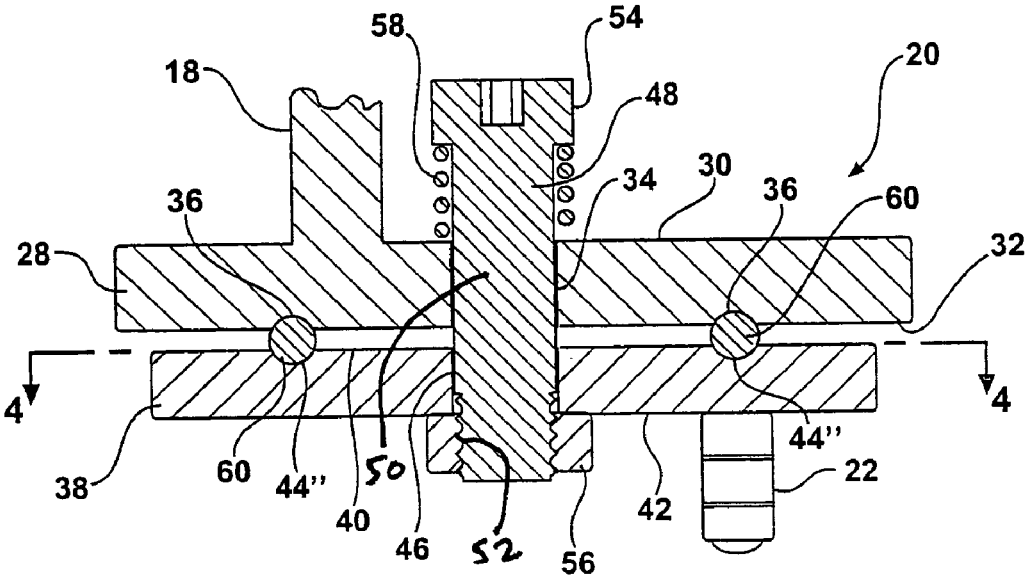
FIG. 2 is a diametrical elevational section view taken through the connecting pin axis illustrating the adjustment between the bell crank and the oscillation pin support.
Figure 3:
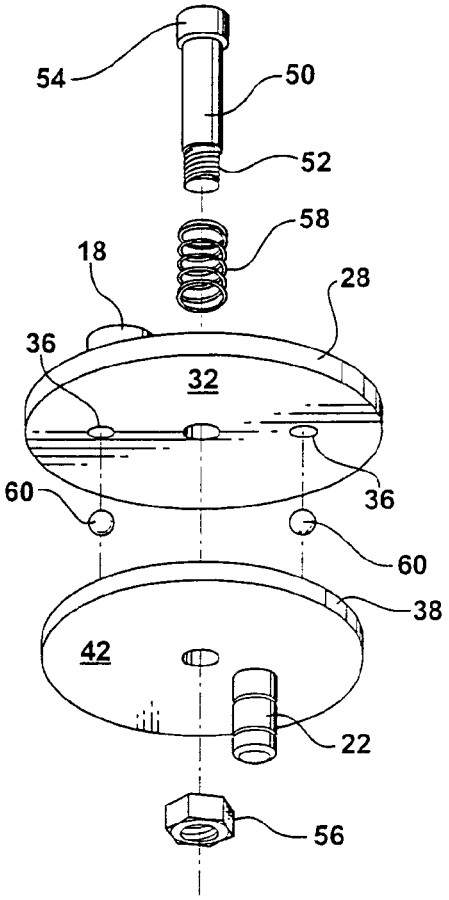
FIG. 3 is an exploded view of the oscillating fan clutch of the invention.

The clutch 20 includes a bell crank element 28, FIGS. 2 and 3, which constitutes a round plate having an upper or first side 30 and a lower or second side 32. The oscillation drive shaft 18 is connected to the bell crank first side 30 as will be appreciated from FIGS. 1 and 2. A central hole 34, FIG. 2, is defined in the bell crank plate extending through the first and second sides thereof, and a pair of semi-spherical detent receiving recesses 36, FIG. 3, are defined in the second side 32 on diametrically opposite sides of the hole 34.

The drive pin support 38 for the oscillating pin 22 is also in the form of a circular plate, FIGS. 2–7, having an upper third side 40 and a lower fourth side 42. It is to be noted that the bell crank second side 32 and the pin support side 40 are flat or planar.

In the illustrated embodiment six recesses 44, 44' and 44" are mounted in the third side 40 equally spaced from each other and the central hole 46 defined in the pin support. If desired additional sets of recesses 44 could be formed in the third side 40 if more than three adjustments of angular oscillation of the fan are desired.

A connecting pin best shown in FIGS. 2 and 3, interconnects the bell crank 28 and the pin support 38. The connecting pin 48 includes a smooth cylindrical shank 50, threads 52 at one end and a head 54 at the upper end. Upon the connecting pin 48 being inserted through the bell crank hole 34 and the pin support hole 46, as shown in FIG. 2, the nut 56 is applied to the threads 52 and a coil spring 58 located between the head 54 and the bell crank first side 30, biases the bell crank 28 and the pin support 38 toward each other. This biasing force produced by the spring 58 will maintain the cylindrical ball detents 60 in their associated recesses 36 and 44 plus.

The biasing force of the spring 58 frictionally locates the ball detents 60 within the recesses 36 and 44+ so that, under normal conditions, the bell crank 28 and the pin support 38 rotate together and no relative location occurs therebetween. However, when it is desired to adjust the degree of oscillation the operator manually rotates the pin support 38, or merely rotates the fan upper structure, so that the spherical surface of the ball detents 60 will ride out of their associated recesses permitting relative rotation between the bell crank 28 and pin support 38. Preferably, the recesses 36 are slightly "deeper" than the recesses 44+ so the ball detents 60 remain in the recesses 36 and ride out of the recesses 44+ during relative rotation of the bell crank 28 and the pin support 38.

Figure 5:
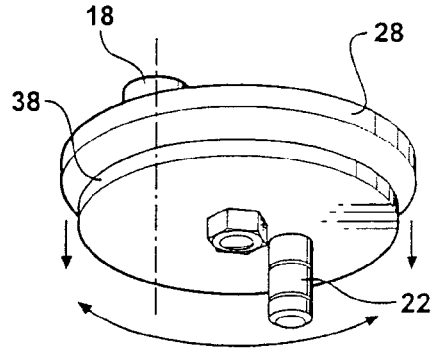
FIG. 5 is a perspective view of the assembled clutch as adjusted to produce a 90° oscillation.
Figure 6:
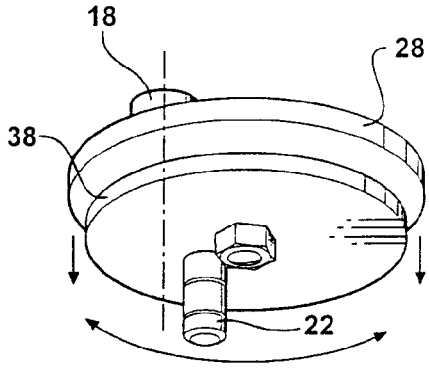
FIG. 6 is a perspective view of the oscillating fan clutch adjusted for producing a 45° oscillation of the fan.
Figure 4:
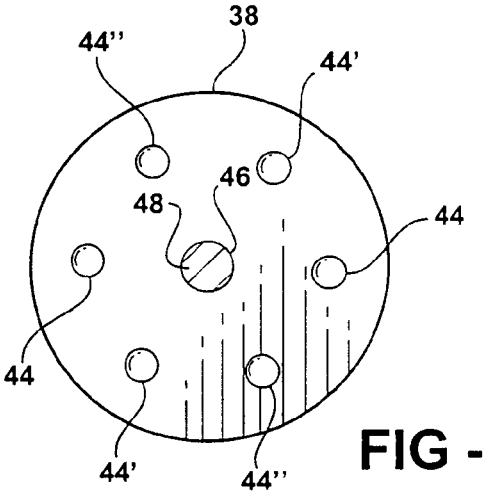
FIG. 4 is a plan view as taken along section 4—4 of FIG. 2, the ball detents being removed for purpose of illustration.
Figure 7:
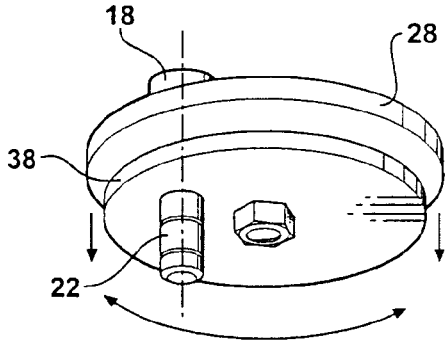
FIG. 7 is a perspective view of the oscillating fan clutch adjusted to produce 0° oscillation.

The greatest degree of fan oscillation, 90°, occurs when the distance separating the axes of the drive shaft 18 and the oscillating pin 22 are the greatest as determined when the ball detents are located in recesses 44", FIG. 5, and oscillation is 45° when recesses 44' are used, FIG. 6. As the distance between the axes of the drive shaft 18 and the connecting pin 48 is equal to the distance between the connecting pin and the oscillating pin 22 rotation of the bell crank 28 and pin support 38 to coaxially align the axis of the drive shaft 18 and the oscillating pin 22 produces 0° oscillation of the fan motor 14, FIG. 7, and in the event of a serious obstruction or restraint the fan motor will terminate oscillation as the detents fall into recess 44 and protect the fan motor from overheating or burn out.

It is appreciated that various modifications to the inventive concepts may be apparent to those skilled in the art, and it is intended that the invention only be limited by the scope of the following claims:

What is claimed is:

1. A clutch for an oscillating fan characterized by its ability to automatically adjust to zero oscillation upon restraint, comprising, in combination:

a fan motor having a drive shaft rotating in a given direction about a first axis;

a bell crank having first and second sides, the first side being mounted upon the drive shaft for rotation therewith about a first axis of rotation;

an oscillating lever drive pin support rotatably mounted on the bell crank about a second axis of rotation radially offset and parallel to the first axis of rotation;

the drive pin support having a third side in opposed, facing relation to the second side of the bell crank and a fourth side including an oscillating lever drive pin adapted to be affixed to a fan oscillating lever, the pin having a third axis radially offset from the second axis a distance equal to the offset of the second axis from the first axis;

a spring biasing the bell crank and drive pin support forward one another; and an indexing mechanism between the second side of the bell crank and the third side of the pin support permitting frictional, releasable relative rotational indexing therebetween about the second axis to adjust the eccentricity between the first and third axes the degree of oscillation, and wherein a restraint imposed upon the fan oscillation causes the bell crank to rotate relative to the pin support, causing the first axis and third axis to automatically become aligned, thereby terminating the oscillation.

2. The clutch of claim 1, wherein the indexing mechanism facilitates predetermined discrete angles of oscillation.

3. The clutch of claim 1, wherein the indexing mechanism facilitates predetermined oscillation angles of 45 and 90 degrees.

4. The clutch of claim 1, wherein the indexing mechanism includes a spherical ball received within semi-spherical recesses defined in at least one of the second and third sides.

* * * * *